United States Patent [19]

Rotter

[11] Patent Number: 4,803,606

[45] Date of Patent: Feb. 7, 1989

[54] MOBILE UNIVERSAL SHOP LIGHT

[76] Inventor: Karl Rotter, 116 Pinecrest Dr., Dartmouth, N.S., Canada, B3A 2J9

[21] Appl. No.: 73,110

[22] Filed: Jul. 14, 1987

[30] Foreign Application Priority Data

Jun. 19, 1987 [CA] Canada ..... 540158

[51] Int. Cl.[4] ..... F21V 21/22; F21V 21/26

[52] U.S. Cl. ..... 362/250; 362/220; 362/413; 362/419; 362/427; 362/253

[58] Field of Search ..... 362/413, 419, 427, 285, 362/287, 250, 220, 804, 253; 403/92, 96

[56] References Cited

U.S. PATENT DOCUMENTS

| | | | |
|---|---|---|---|
| 926,426 | 6/1909 | Koch | 362/413 |
| 1,140,020 | 5/1915 | Bradley | 403/96 |
| 1,410,325 | 3/1922 | Kupferman | 362/427 |
| 2,267,653 | 12/1941 | Hawkins | 362/413 |
| 2,352,496 | 6/1944 | Rose | 362/427 |
| 3,535,509 | 10/1970 | Thornton | 362/413 |
| 3,670,156 | 6/1972 | Schmidt | 362/220 |
| 3,875,398 | 4/1975 | Brindley | 362/157 |
| 3,928,757 | 12/1975 | Nelson | 362/804 |
| 4,232,357 | 11/1980 | Dietz | 362/285 |
| 4,463,413 | 7/1984 | Shirley | 362/427 |

FOREIGN PATENT DOCUMENTS

| | | |
|---|---|---|
| 438134 | 11/1946 | Canada . |
| 496047 | 9/1953 | Canada . |
| 1041979 | 11/1978 | Canada . |
| 1096348 | 2/1981 | Canada . |
| 1116574 | 1/1982 | Canada . |

OTHER PUBLICATIONS

American Express EVA Solarium Brochure, published in Canada, Jul., 1986.

*Primary Examiner*—Andrew M. Dolinar
*Attorney, Agent, or Firm*—Nixon & Vanderhye

[57] ABSTRACT

The invention relates to a mobile universal shop light particularly suited for use in illuminating various aspects of motor vehicles and related machinery during maintenance and repair. The mobile shop light of this invention is comprised of a lower stand mounted on means to provide mobility, a lower stand bar rigidly attached to the lower stand and which extends upward from the lower stand in a direction perpendicular to the plane of the lower stand, an upper stand bar which telescopes into the lower stand bar so as to allow the upper end of the upper stand bar to be positioned at different heights, means to secure the upper stand bar in position relative to the lower stand bar, attaching means connected to the upper end of the upper stand bar which adjustably attaches to the upper stand bar an elongated light fixture containing illuminating means and power supply means. The attaching means allows the fixture to rotate about its longitudinal axis and to be positioned with its longitudinal axis perpendicular to the upper stand bar and at intermediate angles to the perpendicular.

11 Claims, 6 Drawing Sheets

MOBILE UNIVERSAL SHOP LIGHT

FIELD OF THE INVENTION

The present invention relates to a mobile universal shop light particulary suited for use in illuminating various aspects of motor vehicles and related machinery during maintenance and repair.

BACKGROUND AND SUMMARY OF THE INVENTION

The invention is particularly suited to providing illumination for mechanics carrying out maintenance or repair on motor vehicles. Its use is not limited to motor vehicles, however, but can be used for aircraft, marine and other uses.

Proper illumination of the work area has been a longstanding and constant problem for mechanics and related workmen. The prior art solution to the problem has been the use of a so-called "drop light" or "trouble light". The "drop light" is normally comprised of a cord with a socket and switch at the end of the cord remote from the electrical plug. The socket usually received a light bulb of suitable wattage and which was protected from breakage by a cage or protective covering which allowed the light to radiate essentially unimpeded from the bulb. The cage usually had a handle at one end for hand held operation and a hook at the other to allow the "drop light" to be attached to something to allow for hands free operation. Unfortunately, convenient places to hang the light were frequently not available or when available resulted in the light shining in the wrong direction. Valuable mechanic's time was frequently lost trying to position the "drop light" properly, frequently with unsatisfactory results. The "drop light" shortcomings present a constant irritant to users and lead to decreased productivity.

To solve the problem a light was needed which could be quickly and effectively positioned, allow hands free operation and which abundantly illuminates any part of the motor vehicle or equipment.

The present invention fulfills these requirements and provides effective illumination with ease of positioning thus eliminating the irritants and the inefficiency experienced by the workmen. The invention is comprised of a lower stand suitably mounted on casters or otherwise to provide mobility, a hollow lower stand bar rigidly attached to the lower stand and which extends in a vertical direction perpendicular to the plane of the lower stand, an upper stand bar which telescopes into the lower stand bar so as to allow the upper end of the bar to be positioned at different heights, attached to the upper end of the bar is an attaching means which adjustably attaches an elongated light fixture containing a plurality of fluorescent tubes and a plurality of spot lights, the attaching means allowing the fixture to rotate 360° about its longitudinal axis and to be positioned with its longitudinal axis horizontal to the ground and perpendicular to the upper stand bar and at intermediate positions up to ±45° from horizontal.

In another aspect of the present invention, the light fixture may be rotated into a position substantially parallel and adjacent to the upper and lower stand bars in the vertical position which, in use, provides an additional lighting position but also primarily allows for the compact storage and transport of the mobile shop light through narrow passageways: such as doors and the like and for transport on vehicles.

In yet a further aspect of the present invention, the light fixture may be provided with a power supply such as a 110 volt power source mounted thereto to obviate the need to utilize additional extension cords.

The invention allows itself to be placed over, under and into equipment for proper illumination of the work area.

In yet another embodiment of the present invention, the light fixture, including switches, may be suitably modified so as to be completely sealed thus providing a vapour-proof light fixture for use in areas where vapours are produced. Such vapour-proof fixtures would prevent the vapours from contacting the hot lights or from contacting sparks and the like omitted from the switches or from loose connections, thus precluding explosions.

In another aspect of the present invention, a protective shield in the form of a wire mesh screen or the like may be provided to protect the lights from damage and also to protect the user from being burned through accidental contact with the hot flood lights.

The present invention will be better understood through the following detailed description of a preferred embodiment in conjunction with the accompanying drawings in which.

DETAILED DESCRIPTION OF THE PREFERRED EMBODIMENT

Figure 1:
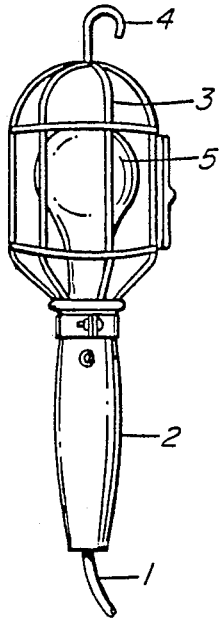
FIG. 1 PRIOR ART
FIG. 1 is a drawing of the prior art "drop light".

FIG. 1 illustrates the prior art "drop light" used by mechanics to illuminate the work area. It is comprised of an electric cord 1 to provide power to the light bulb 5. The "drop light" must either be held by handle 2, suspended from something by hook 4 or laid on something. There is normally a grill 3 which protects the light bulb and allows light to be emitted from the bulb to the work. Often the grill forms only one half of the protective surface with the other half being a solid surface capable of reflecting light. The difficulty in using the "drop light" was in finding a place to hang or lay it and being able to direct the light onto the work area. If a suitable place could not be found it had to be hand held. The "drop light" proved to be an inefficient and ineffective way of illuminating work surfaces.

Figure 2:
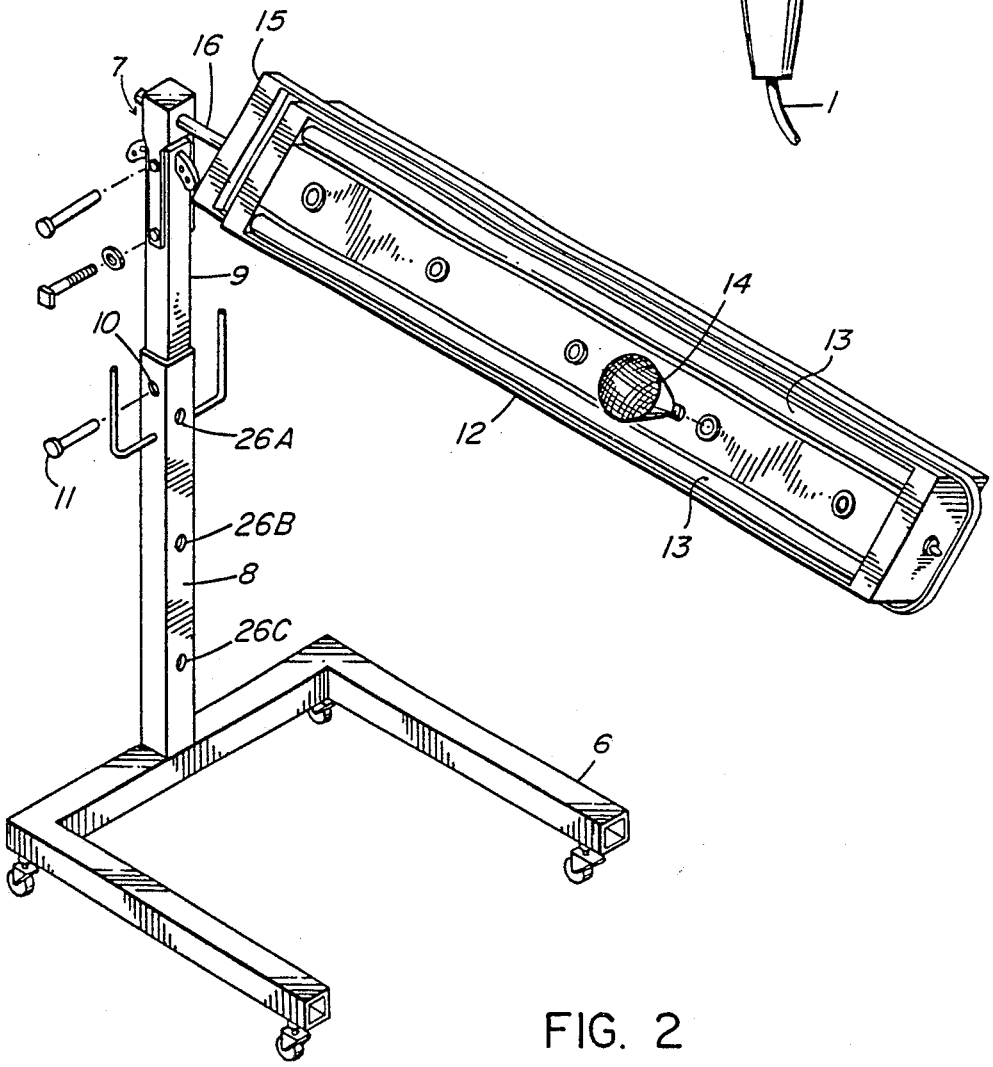
FIG. 2 is a drawing in perspective of a preferred embodiment of the invention.

The preferred embodiment of the invention is depicted in perspective view in FIG. 2. The lower stand 6 is made of rigid material such as steel and is of such dimensions as to provide a solid base for the unit. Casters, wheels or other suitable means are attached to the bottom of the lower stand for mobility. A lower stand bar 8 of hollow construction is rigidly attached to the lower stand and projects in a vertical direction perpendicular to the plane of the lower stand and is inserted into the hollow lower stand bar 8 so that the longitudinal axis of both are coincident is an upper stand bar 9 of similar construction. There are a plurality of holes in upper stand bar 9 which can be aligned with hole 10 in the lower stand bar 8 and secured in position by inserting pin 11 through hole 10 and a corresponding hole in upper stand bar 9. The height of the upper end of the upper stand bar can be varied relative to the lower stand by alignment and pinning of the appropriate holes in the upper stand bar with the lower stand bar. The upper end of upper stand bar 9 contains an attaching means 7 for attaching the light fixture to the stand. The light fixture 12 is an elongated generally rectangular frame containing electrical sockets for mounting a plurality of fluorescent lamps 13 and a plurality of spot lamps 14. These lamps provide the illumination for the working area. One of the ends of the fixture 15 which is perpendicular to the longitudinal axis of the fixture has rigidly attached to its a mounting pin 16, which is perpendicular to the end and coincident with the longitudinal axis and is used to attach the fixture to the upper stand bar by insertion through a mounting hole in the upper stand bar attaching means. Cotter pins are used to prevent the mounting pin 16 from disengaging from the attaching means. The mounting pin 16 is free to rotate within the said mounting hole, enabling the light fixture to be rotated 360° about its longitudinal axis.

In another embodiment which is not shown, the light fixture 12 contains a series of light sockets for receiving flood lights and may also be provided with a protective shield in the form of a wire mesh screen or the like to proect the lights from damage and also to protect the user from being burned through accidental contact with the hot flood lights.

Figure 3:
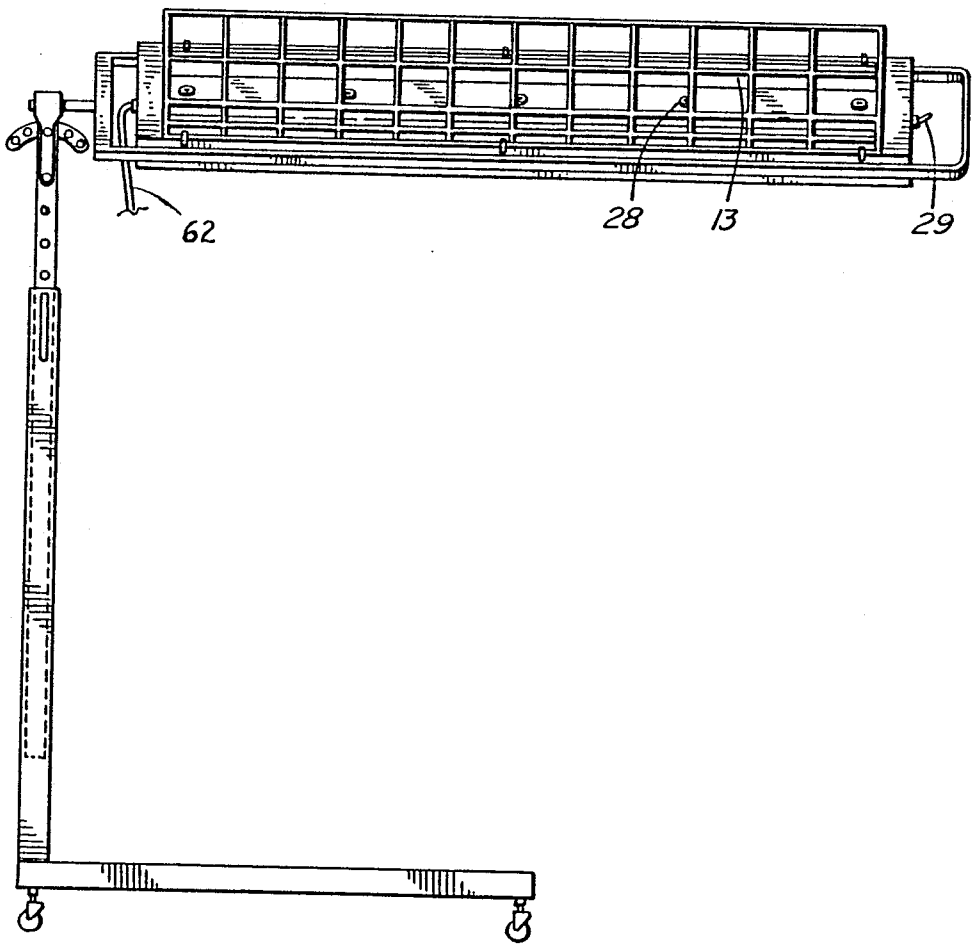
FIG. 3 is a side view of the preferred embodiment of FIG. 2 with a protective screen in place.
Figure 6:
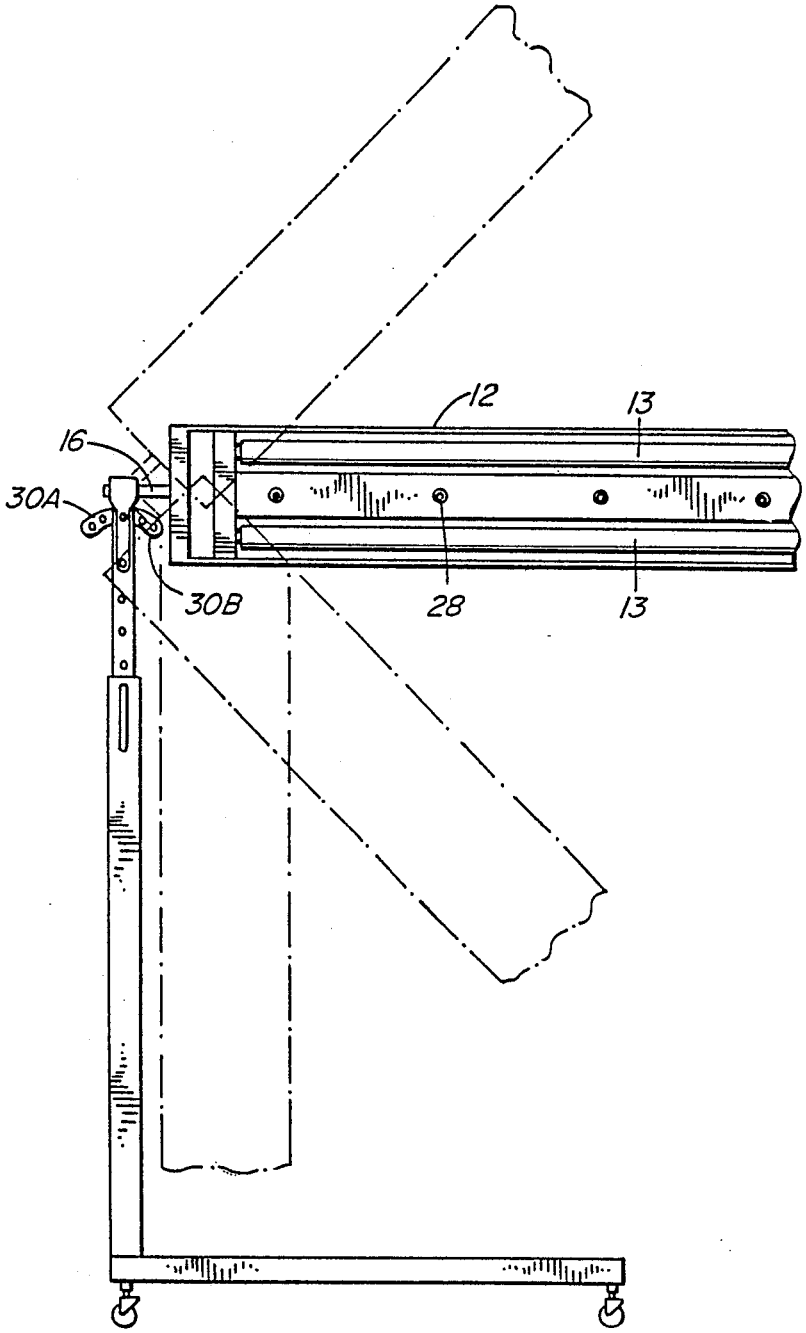
FIG. 6 is a side view of the preferred embodiment showing alternate vertical angle light fixture positions.
Figure 7:
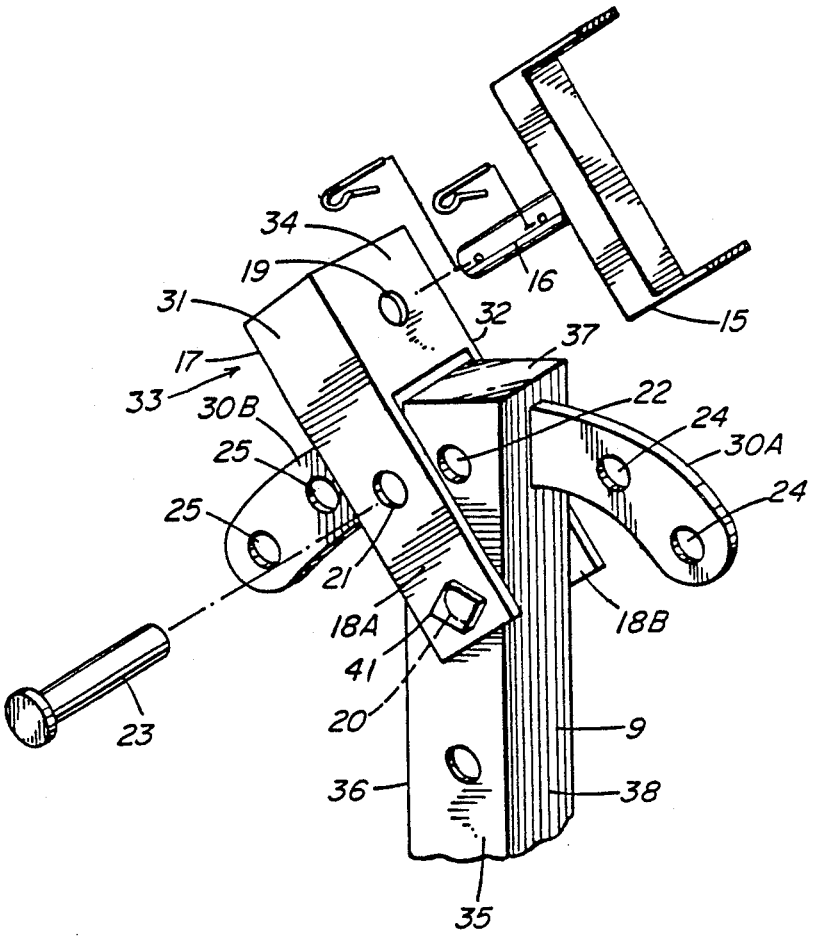
FIG. 7 shows the detail of the attaching means of the preferred embodiment.

FIG. 3 is a detailed view of the upper end of the upper stand bar 9 and the attaching means. The attaching means allows the light fixture to be aligned with its longitudinal axis in a horizontal position parallel to the plane of the lower stand, at an angle of ±45° to the horizontal and intermediate positions between these limits. The light fixture 12 can be so aligned by the pivoting action of the attaching means. Throughout the various alignments the attaching means constains the degrees of freedom so that the longitudinal axis of the fixture remains in a plane containing the longitudinal axis of the lower and upper stand bars 8 and 9 respectively perpendicular to and bisecting the plane of the lower stand 6. The attaching means is comprised of two major parts as shown in FIG. 7. The first piece 17 is a clevis-like apparatus which can be made from the same material as the lower stand bar. This first piece 17 is generally formed of a rigid holllow bar of rectangular cross-section having two opposing sides 31 and 32 which forms two flanges **18*a* and 18b which extends from the main body portion 33. The main body portion 33, which is defined by a plate 34 which is perpendicular to the flanges 18*a* and 18*b*, contains a hole 19 adopted to receive the mounting pin 16. A hole 20 is located in each flange near the end remote from the main body portion 33 and is used to bolt the first piece 17 to the upper stand bar 9 so as to allow it to pivot about the bolt. A further hole 21 is provided in each flange at a predetermined distance from the bolt 41. A corresponding hole 22 is located in the upper stand bar 9 such that the first piece 17 can be fixed in position by inserting pin 23 through holes 21 and 22. The second piece of the attaching means showing FIG. 7 is comprised of two flanges 30*a* and 30*b* rigidly attached to and extending from the sides 36 and 38 of the upper stand bar 9 perpendicular to the sides 35 and 37 containing the holes 20 and 22. These flanges 30a and 30b contain a plurality of holes 24 and 25 aligned on an arc of a circle centred on hole 20 with a radius equal to the distance between holes 20 and 21. The first piece 17 of the attaching means can therefore be pivoted about bolt 41 and fixed in position by sliding pin 23 through holes 21 and 22 or 21 and any of the plurality of holes 24, 25 in flanges 30a and 30b. Thus this arrangement permits the light fixture to be aligned at different angles from the horizontal as shown in FIG. 6**.

Figure 5:
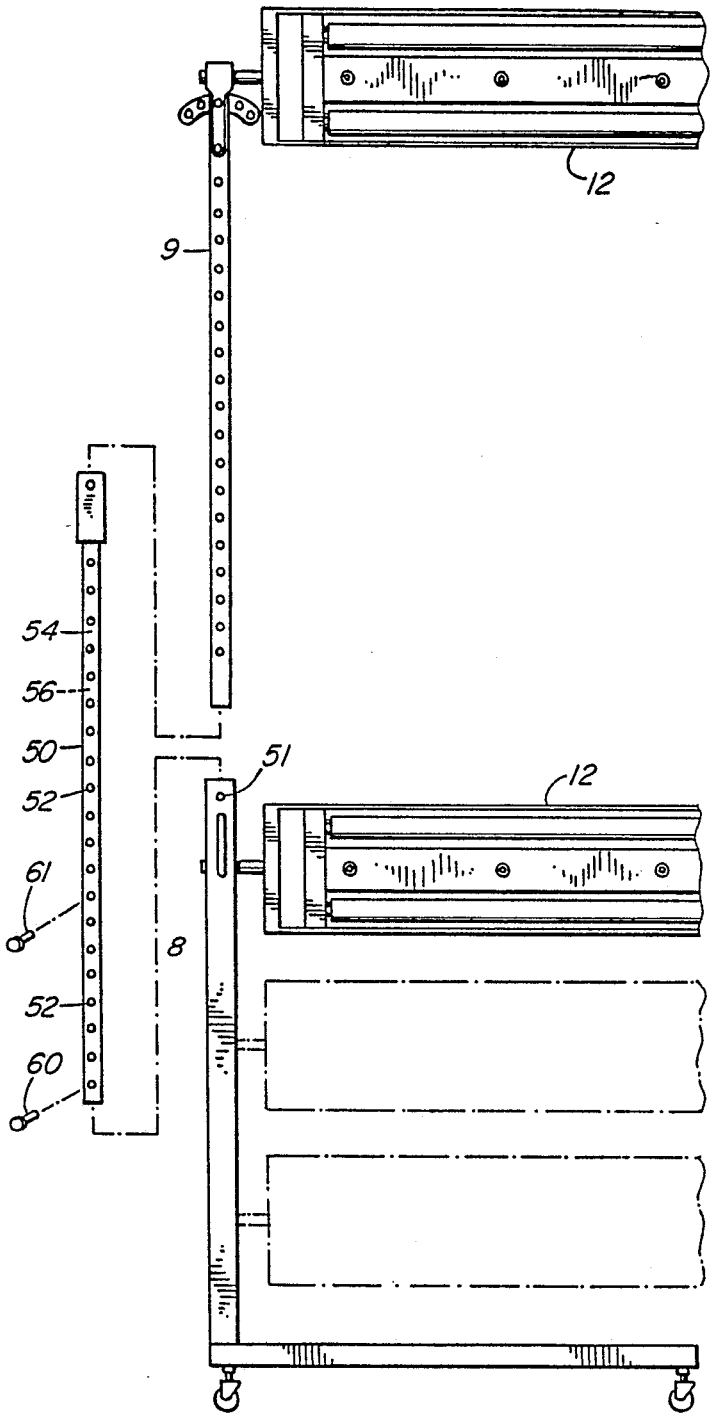
FIG. 5 is a side view of the preferred embodiment showing different height positions of the light fixture.

In a further aspect of this invention the upper stand bar 9 and attaching means one embodiment of which is generally shown in FIG. 7, can be removed and the fixture mounted directly on the lower stand bar as shown in FIG. 5. This permits the light to be positioned under motor vehicles and equipment and to illuminate the lower portions of the work. The fixture 12 is mounted directly onto the lower stand bar 8 by inserting the mounting pin 16 through one of a plurality of holes 26a, 26b, 26c in the lower stand bar and suitably securing the mounting pin 16 in place by the use of cotter pins or the like so the fixture is free to rotate 360° about the mounting pin axis. This allows the light to be directed in any direction so as to properly illuminate the work surface. FIG. 5 shows the upper stand bar 9 removed from the lower stand bar 8 but it is not necessary to remove it in order to attach the fixture to the lower stand bar.

In yet another aspect of the invention shown in FIG. 5, the maximum height of the light fixture 12 may be further extended by positioning between upper and lower stand bars 8 and 9 at least one of a series of height extension sections 50. The height extension section 50 is of a generally hollow bar configuration and is adapted to be received within the upper and lower stand bars. The height extension section 50 is provied with a plurality of holes 52, which pass through surfaces 54 and 56 of the height extension section. In use, height extension 50 is mounted within the upper and lower stand bars 8 and 9. The lowest of holes 52 is aligned with hole 51 of the lower stand bar 8 and a mounting pin 60 is used to lock height extension section 50 within the lower stand bar 8. Similarily, mounting pin 61 is adapted to secure the upper portion of the height extension section 50 within upper stand bar 9 when placed through one of a series of the aligned holes (not shown). The height of the light fixture 12 may further be increased by removing pin 61 and telescopically sliding the upper stand bar along the height extension section 50. Pin 61 is then again placed within one of the series of aligned holes at a position higher than was previously achieved. Thus, height extension section 50 provides a means to extend and adjust the height of the fixture 12 at discrete levels above the previous maxiumum, the discrete levels being determined by the spacing of holes 52.

Figure 4:
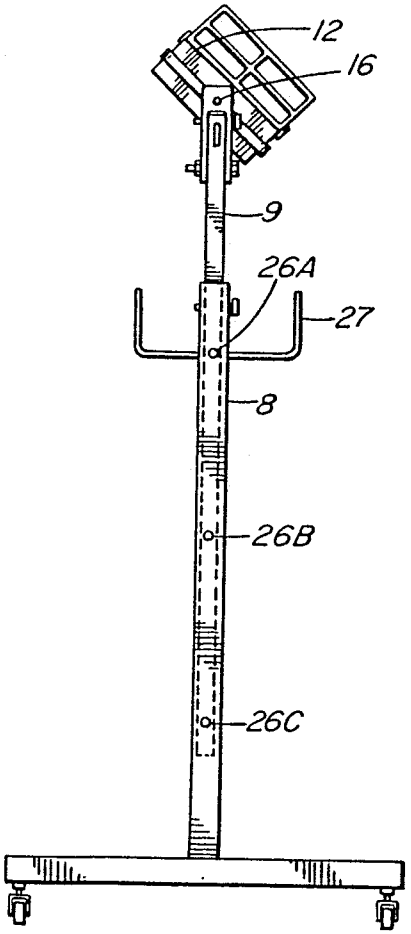
FIG. 4 is a back view of the preferred embodiment of FIG. 2 with a protective screen in place.

FIG. 4 shows a back view of the preferred embodiment illustrating handle 27 which can be used to position the shop light by moving it about on its wheels or coasters. In addition, handle 27 can be used to coil electrical cords and hold tools. FIG. 4 also provides an end view of the fixture which is free to rotate 360° about its mounting pin axis 16.

FIG. 6 is a side view showing the fixture 12 in a horizontal position and also alternate fixture positions at ±45° to the horizontal. Intermediate positions are possible depending upon the number and spacing of the holes in the flanges 30*a* and 30*b* mounted on the upper stand bar 9. It is also possible depending upon the dimensions of the various components to achieve angles greater than 45°.

An important aspect of the invention is the ability to position the fixture 12 to be rotated to the vertical fold-fown position which is a position parallel and adjacent to the upper and lower stand bars 8 and 9. If the dimensions of the fixture 12 are such that rotation to the vertical positions prohibited when the light is positioned about the horizontal axis as shown in FIG. 6, then the fixture 12 is then first rotated 90° about the horizontal axis prior to its rotation about the vertical axis to the vertical fold-down position.

Also illustrated in FIG. 3 are the plurality of sockets 28 the fluorescent tubes 13 and theon-off switch 29 and electrical cord 62. The fixture is rotatable around the axis of mounting pin 16 regardless of the position of the fixture relative to the horizontal.

Electrical cord 62 may be attached to an extension cord to supply electrical power to the fluorescent tubes 13 or may instead be attached to a power supply (not shown) such as a 110 volt power source mounted to the end of fixture 12 proximate to mounting pin 16.

Figure 8:
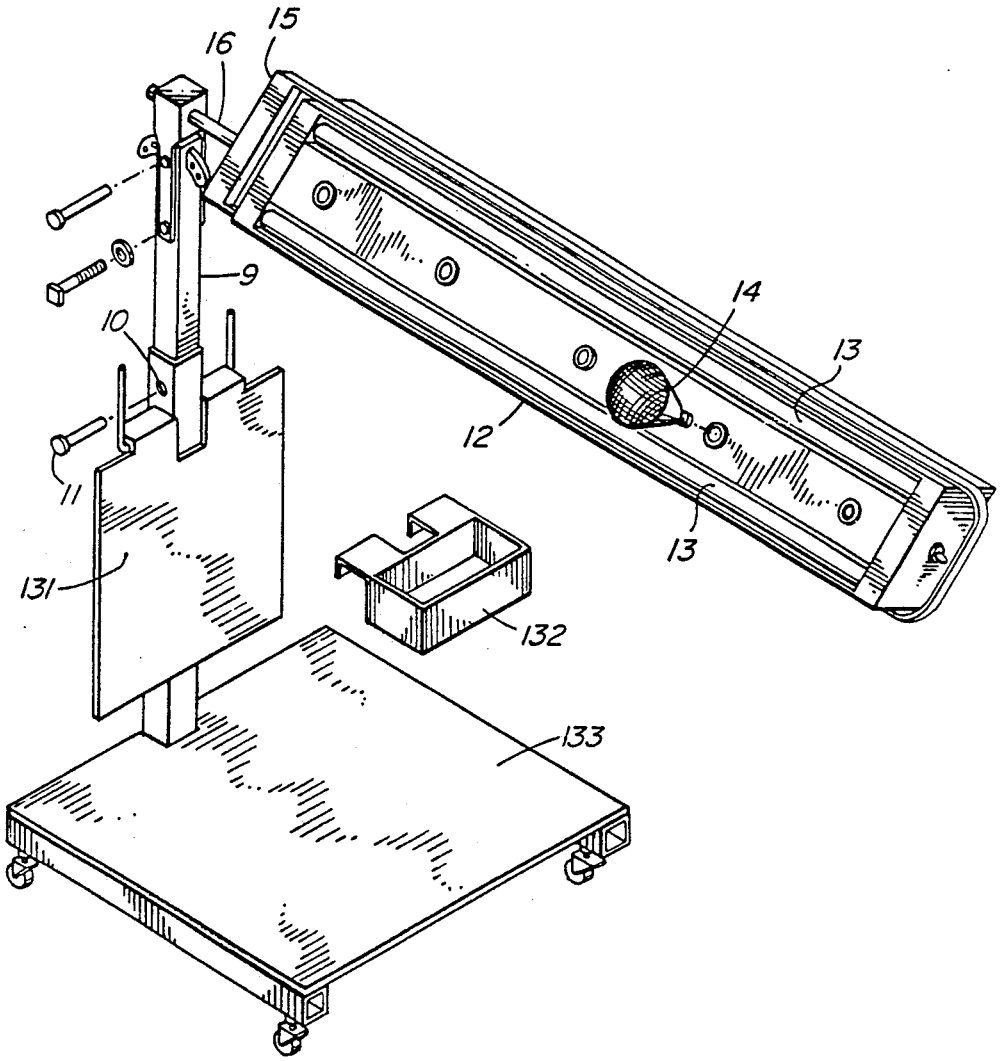
FIG. 8 is a perspective drawing of the preferred embodiment with a collapsible work table and an optional tool tray.

FIG. 8 is a perspective view of a further embodiment of the invention with a collapsible work table 131 a tool tray 132 and a platform 133 added. The work table 131 is shown in the collapsed position. When the table is swung into the horizontal position and secured there, it can be used to hold parts removed from the motor vehicle or other equipment being worked on, to hold tools, manuals, drawings or other materials necessary to complete the task. The platform 133 can be used in a similar fashion and is suitable for positioning and holding heavier objects as well. The tool tray 132 can be used to hold tools so they are readily accessible.

The invention is very flexible in providing ample and constant illumination to the work area. It can be positioned inside a motor vehicle, under the vehicle, under the hood of a vehicle. The fixture can be lowered or raised, tilted at an angle to the horizontal and rotated so as to fit into and provide illumination to areas which are difficult to access. It provides hands free and safe work environment.

Modifications readily suggest themselves with respect to various aspects of the invention without detracting from the overall invention.

The embodiments of the invention in which an exclusive property or privilege is claimed are defined as follows:

1. A mobile shop light comprising a lower stand mounted on means to provide mobility, a lower stand bar rigidly attached to the lower stand and which extends upward from the lower stand in a direction perpendicular to the plane of the lower stand, an upper stand bar which telescopes into the lower stand bar so as to allow the upper end of the upper stand bar to be positioned at different heights, means to secure the upper stand bar in position relative to the lower stand bar, attaching means connected to the upper end of the upper stand bar which adjustably attaches to the upper stand bar an elongated light fixture containing illuminating means and power supply means, said attaching means allowing the fixture to rotate about its longitudinal axis and to be positioned with its longitudinal axis perpendicular to the upper stand bar and at intermediate angles to the perpendicular; and the attaching means is comprised of a body with two parallel flanges disposed from the body being rotatably attached to the upper stand bar, the fixture rotatably attached to the main body, the main body constrained to rotate about a centre and being fixed in various positions by means of pinning through holes located in flanges connected to the upper stand bar.

2. The mobile shop light of claim 1 wherein the mobility means are rollers, casters or wheels.

3. The mobile shop light of claim 2 wherein the means to secure the upper stand bar to the lower stand bar is a pin passing through aligned holes in the stand bars.

4. The mobile shop light of claim 1 and further comprising a work table, a tool tray and a platform, which platform is located on the lower stand.

5. The mobile shop light of claim 1 in which the illuminating means was comprised of a plurality of fluorescent tubes and/or a plurality of spot lights.

6. The mobile shop light of claim 5 in which the fixture can be positioned to maximum angle of 45° to the perpendicular.

7. The mobile shop light of claim 6, in which the fixture can be placed in a vertical fold-down position adjacent and parallel to the upper and lower stand bars.

8. The mobile shop light of claim 5, wherein the fixture is provided with a protective screen.

9. The mobile shop light of claim 8, wherein the protective screen is a wire mesh screen.

10. A mobile shop light comprising a lower stand mounted on means to provide mobility, a lower stand bar rigidly attached to the lower stand and which extends upward from the lower stand in a direction perpendicular to the plane of the lower stand, an upper stand bar which telescopes into the lower stand bar so as to allow the upper end of the upper stand bar to be positioned at different heights, means to secure the upper stand bar in position relative to the lower stand bar, attaching means connected to the upper end of the upper stand bar which adjustably attaches to the upper stand bar an elongated light fixture containing illuminating means and power supply means, said attaching means allowing the fixture to rotate about its longitudinal axis and to be positioned with its longitudinal axis perpendicular to the upper stand bar and at intermediate angles to the perpendicular; further, the said means to secure the upper stand bar to the lower stand bar is a pin passing through aligned holes in the stand bars; and the maximum height of the lighting fixture may be increased by utilizing a height extension section, said height extension section having generally a hollow bar configuration adapted to be received between the upper and lower bars, said height extension section being provided with a plurality of holes extending completely through the height extension section, said plurality of holes being of substantially the same diameter as the holes located on said upper and lower stand bars, each of said holes when in alignment being adapted to receive a pin therethrough so as to secure the height extension section within and between said upper and lower stand bars thereby to provide a means to extend the height of the fixture above at discrete heights above a previous maximum, said discrete heights being determined by the spacing between the plurality of holes of said height extension section.

11. A mobile shop light comprising a lower stand mounted on means to provide mobility, a lower stand bar rigidly attached to the lower stand and which extends upward from the lower stand in a direction perpendicular to the plane of the lower stand, an upper stand bar which telescopes into the lower stand bar so as to allow the upper end of the upper stand bar to be positioned at different heights, means to secure the upper stand bar in position relative to the lower stand bar, attaching means connected to the upper end of the upper stand bar which adjustably attaches to the upper stand bar an elongated light fixture containing illuminating means and power supply means, said attaching means allowing the fixture to rotate about its longitudinal axis and to be positioned with its longitudinal axis perpendicular to the upper stand bar and at intermediate angles to the perpendicular; further, the mobility means are rollers, casters or wheels;

the said means to secure the upper stand bar to the lower stand bar is a pin passing through aligned holes in the stand bars; and the maximum height of the lighting fixture may be increased by utilizing a height extension section, said height extension section having generally a hollow bar configuration adapted to be received between the upper and lower bars, said height extension section being provided with a plurality of holes extending completely through the height extension section, said plurality of holes being of substantially the same diameter as the holes located on said upper and lower stand bars, each of said holes when in alignment being adapted to receive a pin therethrough so as to secure the height extension section within and between said upper and lower stand bars thereby to provide a means to extend the height of the fixture above at discrete heights above a previous maximum, said discrete heights being determined by the spacing between the plurality of holes of said height extension section.

* * * * *